United States Patent [19]

Mosebrook et al.

[11] 4,413,867

[45] Nov. 8, 1983

[54] MULTI-UNIT STORAGE CABINET

[75] Inventors: Dennis R. Mosebrook, Spring Grove; Wayne C. Seeley, York, both of Pa.

[73] Assignee: Dentsply Research & Development Corp., Milford, Del.

[21] Appl. No.: 274,689

[22] Filed: Jun. 17, 1981

[51] Int. Cl.[3] ..... F16B 12/00; A47F 5/00

[52] U.S. Cl. ..... 312/111; 312/263; 108/91; 206/509

[58] Field of Search ..... 312/111, 204, 107, 108, 312/263; 108/91; 206/509

[56] References Cited

U.S. PATENT DOCUMENTS

| | | | |
|---|---|---|---|
| 1,340,562 | 5/1920 | Sandmann | 312/111 |
| 2,575,919 | 11/1951 | Kautzmann et al. | 206/509 |
| 3,003,839 | 10/1961 | Bloom et al. | 312/111 |
| 3,168,193 | 2/1965 | Schechter | 206/509 |
| 3,169,640 | 2/1965 | Favre | 206/509 |
| 3,421,801 | 1/1969 | Carpenter et al. | 312/111 |
| 3,529,878 | 9/1970 | Blowers | 312/111 |
| 3,529,879 | 9/1970 | Priest | 312/111 |
| 3,563,624 | 2/1971 | Stice | 312/111 |
| 3,642,337 | 2/1972 | Manheim | 312/111 |
| 3,741,404 | 6/1973 | Jourdain | 108/91 |
| 3,847,460 | 11/1974 | Weidt | 312/111 |
| 3,951,558 | 4/1976 | Komarov | 312/263 |
| 3,974,898 | 8/1976 | Tullis et al. | 312/111 |
| 3,999,818 | 12/1976 | Schankler | 312/111 |
| 4,129,347 | 12/1978 | Godtschalck | 312/111 |

*Primary Examiner*—Victor N. Sakran
*Attorney, Agent, or Firm*—C. Hercus Just

[57] ABSTRACT

A storage cabinet comprising a plurality of identical shell-like sections and similar complementary slidable drawers, each section comprising a molded plastic planar rectangular panel integral along three sides with similar edges of a pair of sidewalls and a rear wall to form a continuous U-shaped wall configuration and a front opening similar in area to the rear wall. In use, the sections are stacked vertically upon each other with the planar panel uppermost and the front openings facing a common front plane except the lowermost section which has the rear wall disposed in said plane to form a base member and drawers of complementary size are slidably supported in all sections except the bottom one. Connecting screws extend between the sidewalls of adjacent sections to connect all sections into a unitary cabinet.

3 Claims, 5 Drawing Figures

MULTI-UNIT STORAGE CABINET

BACKGROUND OF THE INVENTION

The present invention pertains to a multi-unit storage cabinet composed of a stack of similar shell-like sections adapted to be stacked in series of indeterminate height, said sections respectively receiving storage drawers in slidable fashion, especially, but without restriction thereto, adapted to contain sets of artifical teeth or other objects of low profile or of a flat nature. Readily connectable means are provided to secure the successive sections into connected relationship.

The idea of providing a plurality of similar, relatively flat sections of storage-type containers disposed in stacked relationship and secured together is broadly old. Prior examples of devices of this type are disclosed in U.S. Pat. Nos. 3,421,801 to Carpenter et al, dated Jan. 14, 1969; 3,974,898 to Tullis, dated Aug. 17, 1976; and 4,129,347 to Godtschalck, dated Dec. 12, 1978.

It also is old to form similar receptable-type units which are adapted to be stacked in vertical relationship and provided with a base member and a top cover, including means to assemble the stack and secure the similar flat sections or layers in such stacked relationship, the individual members of the stack having open faces for the reception of articles, such as tape recordings and films. Such a structure comprises the subject matter of U.S. Pat. No. 3,529,879 to Priest, dated Sept. 22, 1970.

Still another type of structure formed from similar flat panels having downward extending legs at the corners and arranged in vertically stacked relationship to comprise articles of furniture of different types, including the support of similar drawers of slidable nature, is found in U.S. Pat. No. 3,847,460 to Weidt, dated Nov. 12, 1974.

The multi-unit storage cabinet comprising the present invention has both structural differences from such aforementioned prior devices and utilitarian features not found in such prior art and of a highly useful nature. Details thereof are set forth below.

SUMMARY OF THE INVENTION

It is among the principal objects of the present invention to provide a series of similar, shell-like sections molded from plastic material or the like and characterized by each section having a substantially rectangular planar panel which is integral at three edges thereof with a pair of opposite sidewalls and a rear wall therebetween, said walls being of uniform height and connected at the ends to each other to form a continuous U-shaped wall configuration and a front opening similar in area to said rear wall, said sections being adapted to be arranged in a vertical stack with the planar panels uppermost and the openings of said sections disposed commonly in a vertical front plane, except the lowermost section which has the rear wall arranged in said vertical front plane to comprise a base section, while the planar panel of the uppermost section constitutes the top of the cabinet, the invention also including screw means to connect the sections together into a unitary cabinet structure, each of such sections being adapted to slidably receive similar drawers for storage purposes.

Another object of the invention is to include in said sidewalls enlarged portions having holes formed therein perpendicularly to the planar panel of each section and said holes being adapted to receive self-tapping screws.

A further object of the invention is to form the sidewalls of said sections in composite fashion comprising a pair of parallel, slightly spaced walls of similar thickness, and said laterally enlarged portions which receive the self-tapping screws being disposed between said walls at longitudinally spaced locations, whereby each section has smooth outer and inner surfaces respectively for appearance and slidable engagement with the sides of drawers received in said sections.

Still another object of the invention is to utilize self-tapping screws having a length no greater than the height of said walls of the sections, whereby said screws, which are headless and of uniform diameter throughout, may be threaded into a pair of said sections until said screws are spaced commonly equal distances in the holes in said pair of sections and thereby leave sufficient space in said holes of the uppermost section to receive screws by which additional sections may be attached to the uppermost section of a previously formed stack.

One further object of the invention is to provide the inner surfaces of said planar panels of each section with short, elongated molded reinforcing ribs extending across said panels and being of a uniform depth, the edge of the planar panel adjacent said front opening of each section also having a narrow flange extending toward said opening and having a depth at least equal to the depth of said ribs, whereby said ribs impose no difficulty relative to sliding a drawer into each section through the front opening thereof.

Details of the foregoing objects and of the invention, as well as other objects thereof, are set forth in the following specification and illustrated in the accompanying drawings comprising a part thereof.

SUMMARY OF THE INVENTION

DETAILED DESCRIPTION OF THE PREFERRED EMBODIMENT

Figure 2:
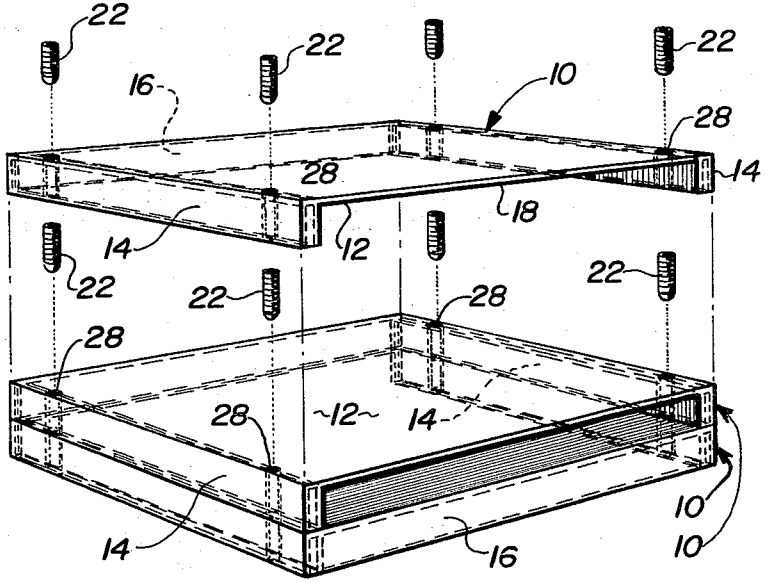
FIG. 2 is a perspective exploded view illustrating the manner in which the sections of the cabinet are assembled and connected to each other by screw means.

Referring to FIGS. 2–5, there is illustrated therein a molded, shell-like section 10, each comprising a flat planar panel 12, the edges of which are integrally connected respectively to a pair of sidewalls 14 and a rear wall 16, said sidewalls 14 and rear wall 16 being connected at their ends to form a U-shaped wall configuration comprising three sides of the shells 10 and leaving a front opening 18.

Figure 1:
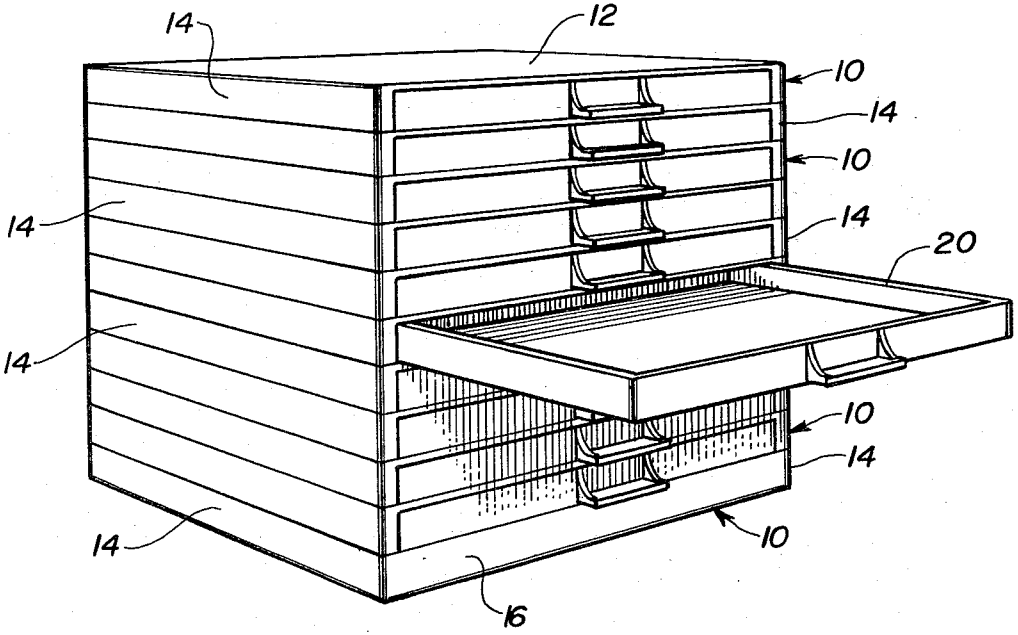
FIG. 1 is a perspective view of an exemplary assembly of a plurality of shell-like sections comprising the present invention and showing all of the sections except one with drawers disposed therein, and said one section having a drawer in extended position relative thereto.

All of the sections 10, with the exception of the lowermost are arranged with the front openings 18 in a common vertical front plane, but as shown in FIGS. 1 and 2, the lowermost section 10 is disposed with the rear wall 16 in the vertical front plane of the cabinet, thereby forming a base, notwithstanding the fact that the base section is identical with the other sections and, moreover, rectangular planar panel 12 of the uppermost section comprises the top of the stack of sections forming a storage cabinet. As formed, each of the sections 10 readily receives one of a plurality of similar storage drawers 20 in slidable manner, it being understood that the drawers are complementary to the space in each of the sections 10 between the sidewalls 14 and the rear walls 16 form a stop to limit the insertion of the drawers into the sections 10.

Figure 3:
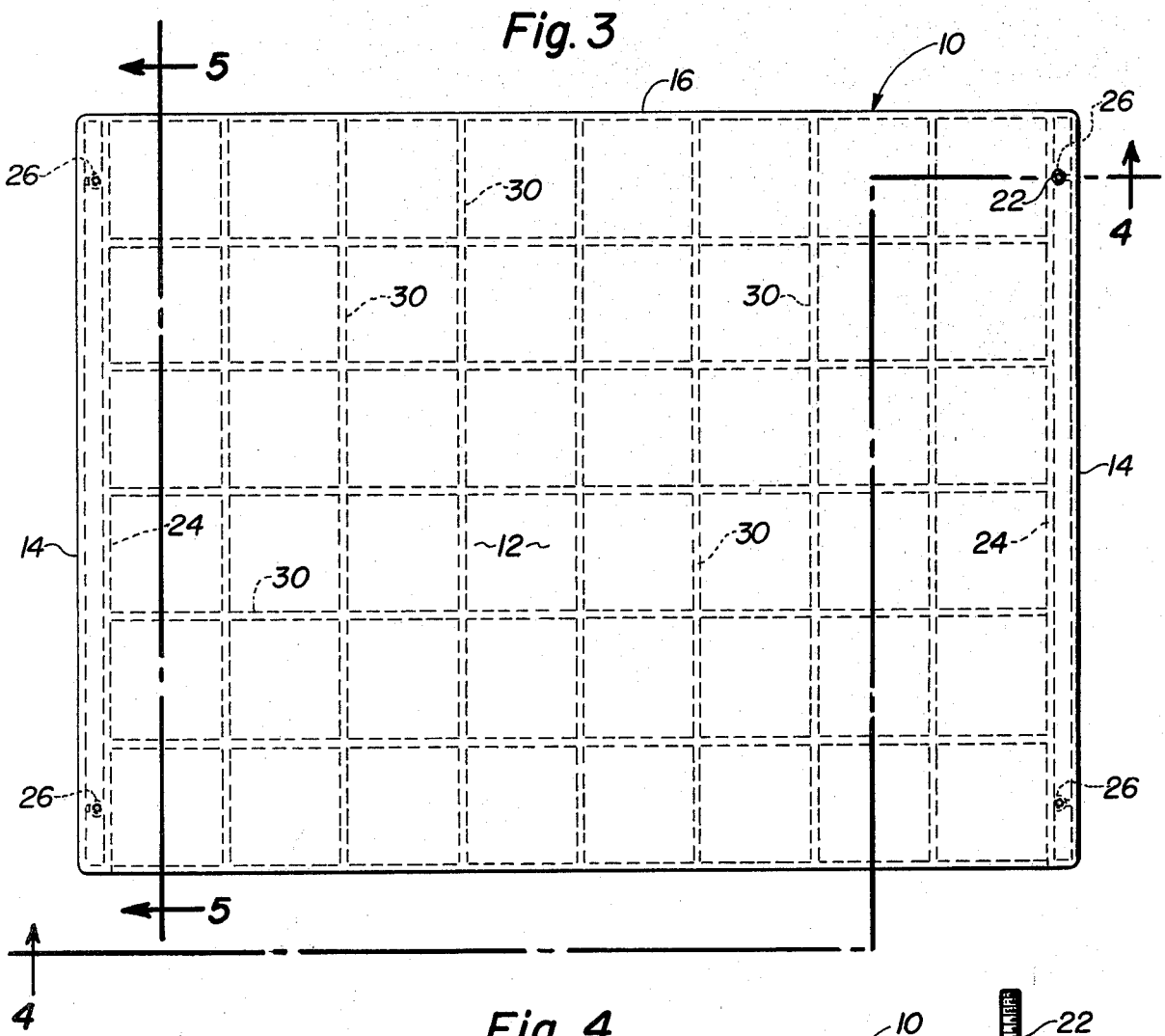
FIG. 3 is a top plan view of one of the similar sections shown in FIGS. 1 and 2.
Figure 4:
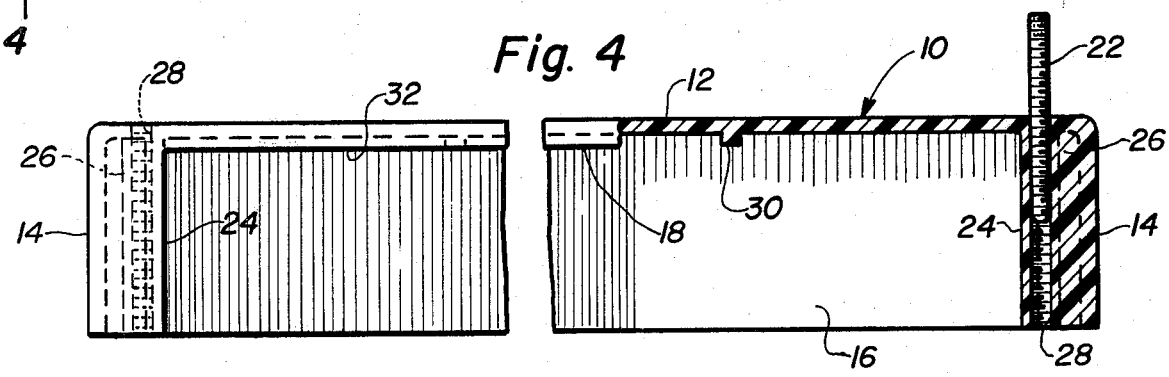
FIG. 4 is an enlarged foreshortened and partially vertically sectioned view of the section shown in FIG. 3, as seen on the line 4—4 thereof.
Figure 5:
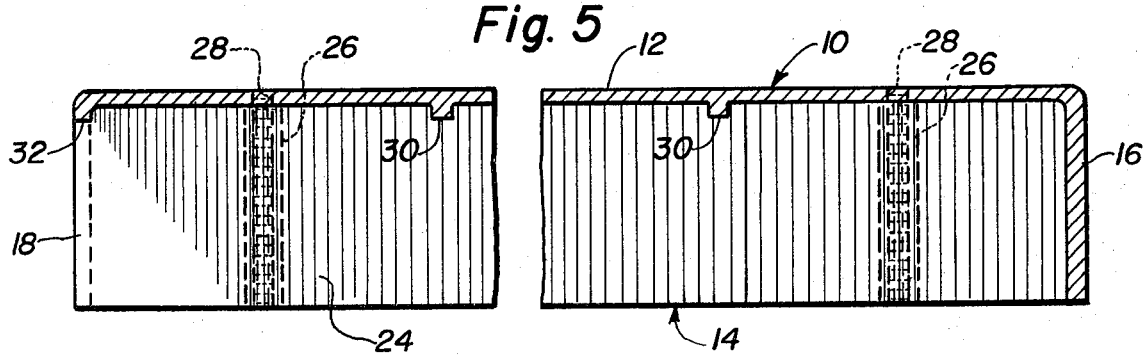
FIG. 5 is an enlarged vertical sectional view of the section shown in FIG. 3, as seen on the line 5—5 thereof.

For purposes of securing the sections 10 in unitary relationship to prevent accidental separation thereof, the present invention utilizes screws 22 of a headless type and of uniform diameter throughout, the length thereof being no greater than the height of the walls 14 of each section. Said screws are of the self-tapping type and have an Allen socket in the upper end thereof. For purposes of utilizing the screws, as best shown in FIGS. 3–5, the sidewalls 14 are of a composite nature and actually comprise in addition to the outer wall 14, an inner companion wall 24. As seen in FIG. 3, between the outer sidewalls 14 and inner companion sidewall 24, are a plurality of molded, enlarged portions 26, which are longitudinally spaced from each other, as shown in FIG. 3, and are provided with holes 28 molded thereinto at the time of forming the sidewalls, the diameter of the holes being slightly smaller than that of the screws 22 in order that the threads of the screws may bite into the walls of the holes 28 to form a secure engagement therewith, as indicated above, the screws 22 being of the self-tapping type.

Another aspect of the screws 22 and the holes 28 is that since the screws 22 are no longer than the height of the sidewalls 14, the preferred method of attaching the sections 10 to each other is to thread the screws down into a pair of the sections 10, such as shown in the lower portion of FIG. 2, the threading extending sufficiently between the two sections that each screw is disposed with half of its length in each adjacent section 10, thus leaving half of the hole in the uppermost section free for reception of one-half length of the succeeding screws to be used in connection with attaching successive sections to be stacked upon each other. In view of the fact that the sections are of uniform nature, and the holes 28 are uniformly placed in each section, the completed assembly of a plurality of the sections 10 as connected together with the screws 22 will result in an exemplary cabinet structure shown in exemplary manner in FIG. 1.

Under circumstances where the area of the planar panel 12 of each section is of appreciable extent, especially to prevent warping or sagging thereof, as shown in FIGS. 3–5, each of the planar panels 12 is formed on the inner surface thereof with longitudinally extending reinforcing ribs 30. As illustrated in FIG. 3, in exemplary manner, the ribs 30 may be formed in a grid pattern to afford strengthening in transverse directions. Also, to prevent any interference between the drawers 20 and the ribs 30, the front opening 18 of each section is provided with a downwardly extending flange 32, which is no longer than the ribs 30, as clearly shown best in FIGS. 4 and 5, whereby no interference between the ribs 30 and the drawers 20 will occur.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

We claim:

1. A storage cabinet comprising a plurality of identical shell-like sections molded from plastic material and characterized by each section having a substantially rectangular planar panel integral at three edges with opposite sidewalls and a rear wall of uniform height and connected at the ends to each other to form a continuous U-shaped configuration and a front opening similar in area to said rear wall, said sections being arranged in a vertical stack with the planar panels uppermost and the openings disposed commonly in a vertical front plane except the lowermost section which has the rear wall in said vertical front plane to comprise a base section having the open face of the shell lowermost and the planar panel of the uppermost section comprising a top of the cabinet, holes in said sidewalls adapted to receive self-tapping screws of no greater length than the height of said sections and said screws extending substantially equally between immediately adjacent sections to secure the sections into a unitary assembly and leave substantially one-half of the depth of the holes in the uppermost section to receive additional screws, the inner surfaces of the planar panel of each section being provided with short molded reinforcing ribs extending thereacross of uniform depth and the edge of the planar panel adjacent said front opening having a narrow flange adjacent said front opening extending toward said opening and having a depth at least equal to the depth of the ribs, and similar drawers of complementary area and height to the spaces in each section slidably supported in all sections except the lowermost base section.

2. The storage cabinet according to claim 1 in which said sidewalls have a transverse dimension greater than the diameter of said screws and said sidewalls having said holes formed therein perpendicularly to the planar panel and adapted to receive said self-tapping screws.

3. The storage cabinet according to claim 2 further characterized by the sidewalls of said sections being of a compound nature comprising a pair of similar panels parallel to each other and spaced apart a slight distance adequate to accommodate laterally enlarged portions therebetween, whereby the inner and outer surfaces of said sidewalls are smooth and straight for exterior appearance of the sections and also provide smooth and unobstructed interior surfaces for slidable reception of a drawer therein.

* * * * *